US007744079B2

(12) United States Patent
Van Netten et al.

(10) Patent No.: US 7,744,079 B2
(45) Date of Patent: Jun. 29, 2010

(54) MULTI-STATION SYSTEM AND METHOD FOR PROCESSING PAPER POSTAL ITEMS

(75) Inventors: Sjoerd Van Netten, Drachten (NL); Jaap Kramer, Drachten (NL)

(73) Assignee: NEOPOST Technologies, Bagneux (FR)

( * ) Notice: Subject to any disclaimer, the term of this patent is extended or adjusted under 35 U.S.C. 154(b) by 20 days.

(21) Appl. No.: 11/969,121

(22) Filed: Jan. 3, 2008

(65) Prior Publication Data

US 2008/0179223 A1 Jul. 31, 2008

(30) Foreign Application Priority Data

Jan. 31, 2007 (EP) ..... 07101529

(51) Int. Cl.
*B65H 29/68* (2006.01)

(52) U.S. Cl. ..... 271/69; 271/270; 271/272; 271/275; 271/202; 271/203

(58) Field of Classification Search ..... 271/69, 271/270, 272, 275, 202, 203
See application file for complete search history.

(56) References Cited

U.S. PATENT DOCUMENTS

| | | | | |
|---|---|---|---|---|
| 1,858,320 | A | 5/1932 | Beardsley et al. | |
| 3,827,545 | A * | 8/1974 | Buhayar | 198/461.2 |
| 4,230,218 | A * | 10/1980 | Kunzmann | 198/461.3 |
| 4,970,654 | A | 11/1990 | Francisco | |
| 5,129,641 | A * | 7/1992 | Long | 271/6 |
| 5,178,379 | A | 1/1993 | Edwards et al. | |
| 5,386,984 | A * | 2/1995 | Dal Toso et al. | 271/122 |
| 5,421,699 | A * | 6/1995 | Guiles et al. | 414/788 |
| 6,139,012 | A | 10/2000 | Furuya et al. | |
| 6,338,479 | B1 | 1/2002 | Van Der Werff et al. | |
| 6,687,570 | B1 | 2/2004 | Sussmeier et al. | |
| 7,537,207 | B2 * | 5/2009 | Kutzer et al. | 271/34 |
| 2007/0085259 | A1 | 4/2007 | Grogor et al. | |

FOREIGN PATENT DOCUMENTS

| | | |
|---|---|---|
| DE | 103 50 352 B3 | 1/2005 |
| EP | 1 547 948 A1 | 6/2005 |

* cited by examiner

*Primary Examiner*—Patrick Mackey
*Assistant Examiner*—Luis Gonzalez
(74) *Attorney, Agent, or Firm*—Sughrue Mion, PLLC

(57) ABSTRACT

A transport track extends through first and second stations for transporting paper postal items through the stations. The first and second stations are equipped with first and second drives for driving circulatable surfaces of the respective station along the transport track. The second drive is controlled for driving at least one of the second station's circulatable surfaces at a circumferential speed higher than the circumferential speed of the first station's circulatable surfaces. While a stack of postal items passes from the first station to the second station, highest normal force exerted thereon by the circulatable surfaces of the second station is larger or smaller than the highest normal force exerted thereon by the circulatable surfaces of the first station.

7 Claims, 2 Drawing Sheets

MULTI-STATION SYSTEM AND METHOD FOR PROCESSING PAPER POSTAL ITEMS

TECHNICAL FIELD AND BACKGROUND ART

The invention relates to a multi-station system and to a method for processing paper postal items.

In many cases, the automated production of postal items involves collation of a number of postal items that are to be included in a mail piece. Such postal items may for instance include documents, each constituted by one or more sheets, business reply envelopes, cards on carriers, brochures etc.

One manner of transporting is in mutual alignment against a transport finger that pushes the stack along a transport track. A disadvantage of this manner of transportation is, that the postal items lie loosely on top of each other, which entails a risk of jams, in particular if the items are to be stacked and/or transported at high speed.

In another manner of transporting postal items, the postal items are retained in a mutually fixed position. When transferring the stacked postal items from one station to a next station, the stations being driven by separate drives, the transport track of each station may be driven at a slightly higher speed than the transport track of the preceding station to avoid buckling of the postal items between the stations. However, in such systems, the sheets within a stack tend to be slightly displaced relative to each other in transport direction.

SUMMARY OF THE INVENTION

It is an object of the present invention to provide a solution to reduce misalignment in transport direction between stacked sheets that have been transported along a transport track from one station to a next station.

According to one aspect of the invention, this object is achieved by providing a system for processing paper postal items, comprising a first station, a second station; and a transport track extending through said stations for transporting paper postal items in a transport direction through said first station and from said first station into and through said second station; wherein each of said stations includes: at least one first circulatable surface on a first side of the transport track for guiding postal item material along the transport track; at least one second circulatable surface, opposite of the at least one first circulatable surface and exerting a normal force towards said at least one first circulatable surface; a first drive for driving at least one of the circulatable surfaces of the first station; and a second drive for driving at least one of the circulatable surfaces of the second station; wherein the first drive is controlled for driving the at least one of the first station's circulatable surfaces at a first circumferential speed; wherein the second drive is controlled for driving the at least one of the second station's circulatable surfaces at a second circumferential speed higher than said first circumferential speed; and wherein said circulatable surfaces in at least a downstream section of the transport track in said first station and said circulatable surfaces in at least an upstream section of the transport track in said second station are arranged such that the highest normal force exerted by said circulatable surfaces in at least a downstream section of the transport track in said first station is substantially larger or smaller than the highest normal force exerted by said circulatable surfaces in at least an upstream section of the transport track in said second station.

The invention may also be embodied in a method for processing paper postal items, including transporting at least two stacked postal items along from a first station to a second station; said stations each comprising: at least one first circulatable surface on a first side of a transport track for guiding postal item material along the transport track, at least one second circulatable surface, opposite of the at least one first circulatable surface and exerting a normal force towards said at least one first circulatable surface; driving at least one of the circulatable surfaces of the first station at a first circumferential speed; and driving at least one of the circulatable surfaces of the second station at a second circumferential speed higher than said first circumferential speed; wherein the highest normal force exerted by said circulatable surfaces in at least a downstream section of the transport track in said first station is substantially larger or smaller than the highest normal force exerted by said circulatable surfaces in at least an upstream section of the transport track in said second station.

Because the highest normal force exerted by the circulatable surfaces of the second station on a postal item is larger or smaller than the highest normal force exerted simultaneously on the same postal item by the circulatable surfaces of the first station, the upstream one of the stations reliably maintains control over the stacked set of postal items, until it is free from the upstream station or the downstream station reliably takes over control over the displacement of the stack as of the moment it engages the stack.

If the upstream one of the stations maintains control over the stacked set of postal items, until it is free from the upstream station, postal items that are mutually aligned along the trailing edge are simultaneously released by the upstream one of the stations so that control over all the postal items of the stack is simultaneously handed over to the downstream one of the stations. It is thus avoided that the downstream one of the stations (transporting at a higher speed) engages longer postal items in a stack earlier than it engages shorter postal items in the same stack.

If the downstream station takes over control over the displacement of the stack as of the moment it engages the stack, postal items that are mutually aligned along the leading edge are simultaneously brought under control of the downstream one of the stations so that control over all the postal items of the stack is simultaneously handed over to the downstream one of the stations. It is thus avoided that the upstream one of the stations (transporting at a lower speed) maintains control over longer postal items in a stack longer than it maintains control over shorter postal items in the same stack.

Particular embodiments of the invention are set forth in the dependent claims.

Further aspects, effects and details of the invention are set forth in the detailed description with reference to examples of which some are shown in the schematic drawings.

MODES FOR CARRYING OUT THE INVENTION

Figure 1:
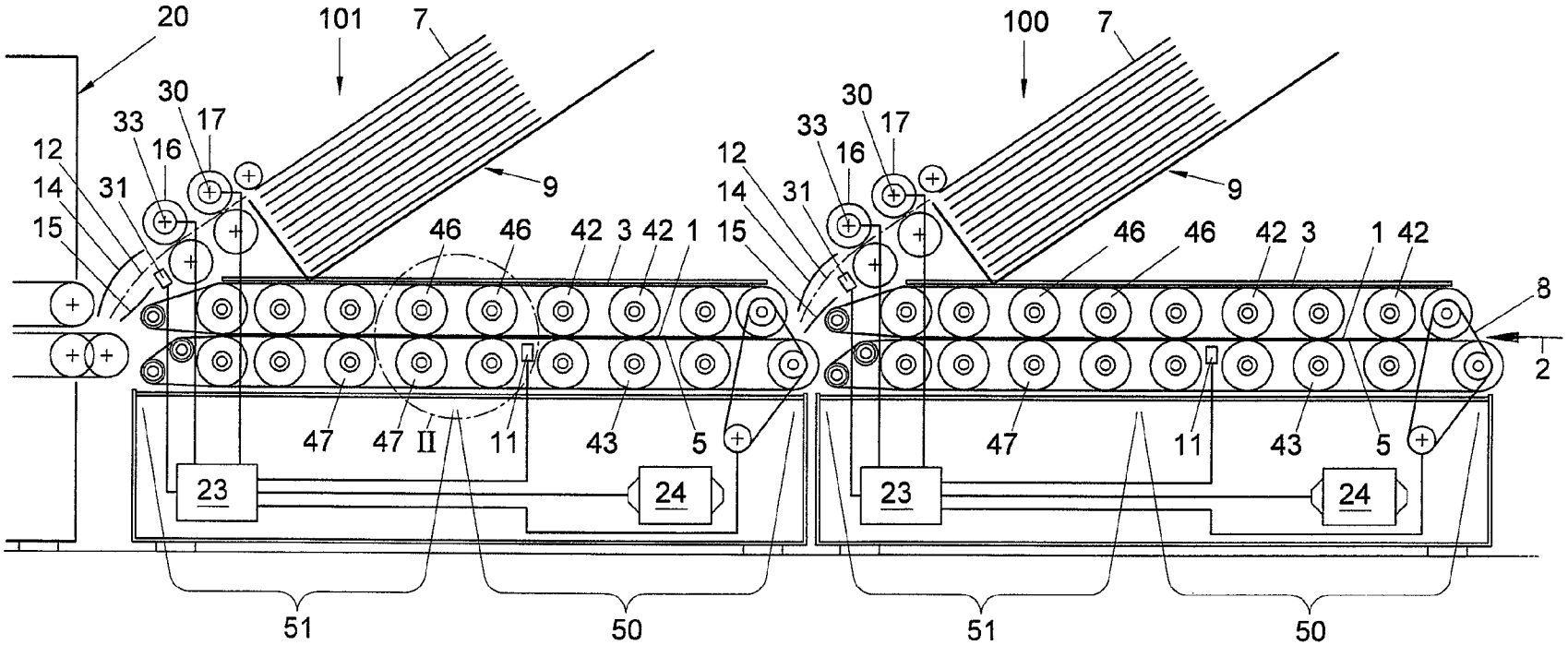
FIG. 1 is schematic side view of a first example of a system according to the invention.

In FIG. 1, an example of a system according to the invention for collating postal items into sets is shown schematically. According to the present example, the system includes mutually identical first and second insert feeder stations 100, 101. A transport track 1 extends through the stations 100, 101 for transporting paper postal items in a transport direction (arrow 2) through the first station 100 and from the first station 100 into and through the second station 101. In the present example, the transport track 1 is defined by circulatable surfaces in the form of upper conveyor belts 3 and lower conveyor belts 5 on opposite sides of the transport track 1 in each of the stations 100, 101. The conveyor belts 3-5 may each include single belts mounted around end rollers. However, one or more of these conveyor belts may include a plurality of narrow belts or strings tensioned parallel to each other. The transport track 1 is for transporting postal items, such as documents (each consisting of one or more sheets), envelopes, cards, carriers for carrying plastic cards such as credit cards and other generally flat items, suitable to be inserted and mailed in an envelope. While being transported along the transport track 1, the postal items each have a leading edge and a trailing edge in the transport track 1 and oriented perpendicular to the transport direction 2.

In FIG. 1, stacks of postal items 6, 7 to be fed individually are shown in hoppers 9. The fed postal items 6, 7 are to be stacked onto and aligned with other postal items (not shown) that are fed along the transport track 1 in the transport direction 2 via an entry 8 of the most upstream station 100.

Each station 100, 101 is equipped with an edge detector 11 for detecting a leading or trailing edge of each postal item in the transport track 1 as the respective edge passes the detector 11.

A feeding track 12 for feeding second postal items 6, 7 extends in a feeding direction from each hopper 9 to the transport track 1. The feeding track 12 is defined between upper and lower guides 14, 15 on opposite sides of the feeding track 12. The feeding track 12 merges with the transport track 1 downstream of the detector 11, for collating each of the second postal items 6, 7 with one of the first postal items 8 transported in the transport track 1. After having been collated, the collated first and second postal items 6, 7, 8 are transported further in the transport direction 2 along the transport track 1. In the present example, the transport track 1 leads to a folding station 20.

For driving the conveyor belts 3, 5, each station 100, 101 is equipped with a drive for driving at least one of its circulatable surfaces. In the present example, the drives each include a central motor 24, which can be coupled to and uncoupled from end rollers of the conveyor belts 3, 5. Clutches 30 and 33 are arranged for coupling and uncoupling the motor 24 to and from feeding rollers 17 and transport rollers 16 for separating and feeding postal items 6, 7 from the hoppers 9. The transmission structures linking the motors 24 to the respective clutches and rollers are not shown.

To avoid buckling and ultimately accumulation of postal items between successive ones of the stations 100, 101 and 20 during transport, the drives of the stations 100, 101, 20 are adjusted for driving the conveyor belts 3, 5 or rollers along the transport track 1 of each of the stations 100, 101, 20 at a slightly lower circumferential speed than the circumferential speed at which the conveyor belt or roller(s) of the next station 101, 20 are driven.

Along the feeding track 12, an edge detector 31 is located for detecting leading and trailing edges of each postal item 6, 7 in the feeding track 12 as the respective edge passes the detector 31. A pulse disk unit (not shown) is coupled to one of the transport rollers 16 along the feeding track 12 and connected to the control system 23 for signaling displacement of items in the feeding track 12 in terms of counted pulses to the control system 23. The control system is arranged for controlling the clutch 33 for stopping the transport roller 16 of the feeding track 12 within a predetermined distance counted by the pulse disk unit 32 after the detection of the leading edge of a postal item 6, 7 has been signaled by the edge detector 31 to the control system 23. Thus, a postal item 6, 7 can be reliably stopped in a waiting position in the feeding track 12.

The control system 23 is connected to the clutch 33 for each time feeding one of the second postal items 6, 7 from its waiting position in the feeding track 12 along the feeding track 12 in response to the detection of the leading edge of a postal item by the detector 11 along the transport track 1. Thus, a postal item 6, 7 is held in a position waiting between the transport roller 16 and an opposite roller while a postal item is transported from an upstream feeder along the transport track 1. Based upon the passing of the leading edge at a photocell of the edge detector 11, the roller 16 is started by causing the clutch 33 to engage, so as to add the postal item 6 or 7 on top of and accurately aligned with the postal item in the transport track 1. The transport roller 16 of the feeding track 12 is stopped as soon as the trailing edge of second postal item has passed a photocell of the edge detector 31.

Because the stacked postal items are retained by the feeding and transport tracks 1, 12 during stacking without sliding relative to each other and are held together after having been stacked, tolerances on the precision with which leading or trailing edges of the stacked postal items 6, 7 are mutually aligned do in practice result in some misalignment of the leading or trailing edges of many of the stacks.

One situation in which such misalignments tend to be caused or increased is when stacked postal items are transferred from the station 100 to the station 101 downstream thereof and from the station 101 to a folding station 20 or an inserting station (not shown) downstream thereof. Such stacked postal items may also include a postal item 6, 7 fed from the station from which the stack is transferred to the next station.

Traction force in transport direction 2 exertable by the conveyor belts 3, 5 of the second station 101 on the stack of postal items is generally larger than friction force contrary to the transport direction 2 exertable on the same stack of postal items by the conveyor belts of the first station 100, because the circulatable surfaces 3, 5 in a downstream section 51 of the transport track 1 in the first station 100 and the circulatable surfaces 3, 5 in an upstream section 50 of the transport track 1 in the second station 101 are arranged such that the highest normal force exerted by the circulatable surfaces 3, 5 in a downstream section 51 of the transport track 1 in the first station 100 is substantially smaller than the highest normal force exerted by said circulatable surfaces 3, 5 an upstream section 50 of the transport track 1 in the second station 101. Thus, a stack of postal items simultaneously engaged by the first and second stations 100, 101 is virtually always under control of the drive of the downstream one of the stations 100, 101.

In the present example, postal items are aligned on the basis of detection, in the transport track 1 and in the feeding track 12, of leading edges of the postal items and accordingly alignment along the leading edges is preferred, as this can be carried out most accurately on the basis of detection of leading edges. While the stacked postal items pass from the first station 100 to the second station 101, traction force in transport direction 2 exertable by the conveyor belts 3, 5 of the second station 101 on the stack of postal items is continuously higher than the exertable friction force contrary to the transport direction 2 exerted on the same stack of postal items by the conveyor belts 3, 5 of the first station 100. Thus, the downstream second station 101 takes over control over the displacement of the stack of postal items virtually as of the moment it engages the stack, so that all postal items that are mutually aligned along the leading edge are simultaneously or almost simultaneously brought under control of the downstream one 101 of the stations. It is thus avoided that the upstream one of the stations 100 (transporting at a lower speed) maintains control over longer ones of the postal items in a stack longer than it maintains control over shorter postal items in the same stack.

Alternatively, for stacks that are aligned along a trailing edge, it is preferred that, while the stack of postal items is simultaneously engaged by the circulatable surfaces of the first and second stations while passing from the first station to the second station, the highest normal force in transport direction exerted by the circulatable surfaces of the second station on the stack of postal items is to be lower than the highest normal force exerted on the same stack of postal items by the circulatable surfaces of the first station.

In the first and second stations 100, 101, the highest normal force exertable onto a postal item by the conveyor belts 3, 5 in a downstream section 51 of the transport track 1 in that station 100, 101 is substantially smaller than the highest normal force exertable on the same postal item by the conveyor belts 3, 5 in an upstream section 50 of the transport track 1 in that station 100, 101. This allows obtaining the difference between the traction and the friction forces exertable by successive stations simultaneously engaging a postal item as it is transferred from one station to the other without having to provide for a general increase or decrease of the highest normal force along the transport track. For instance, in the present example, it has been provided that in each of the two identical stations 100, 101, the highest normal force exertable onto postal items by the conveyor belts 3, 5 in an upstream portion 50 of the transport track 1 is larger than the highest normal force exertable onto postal items by the conveyor belts 3, 5 in a downstream portion 51 of the transport track 1. Thus, if the two stations 100, 101 are positioned in succession for successive transportation of postal items along a transport track 1 extending through these two stations, the traction exertable by the downstream station 101 onto postal items passing from the upstream station 100 to the downstream station 101 is virtually always larger than the friction simultaneously exertable by the upstream station 100 on the postal items being passed.

If stacked postal items aligned along a trailing edge are to be transported, the same principle can for instance be applied in opposite fashion by providing that in each of the two identical stations, the traction exertable onto postal items by the conveyor belts in an upstream portion of the transport track is smaller than the friction exertable onto postal items by the conveyor belts in n downstream portion of the transport track.

The first and second stations 100, 101 are moreover interchangeable with each other, which provides the advantage that the stations can be positioned in any location and exchanged while maintaining that the traction exertable by the downstream station 101 onto postal items passing from the upstream station 100 to the downstream station 101 is larger than the friction simultaneously exertable by the upstream station 100 on the postal items being passed.

The difference between the highest normal forces in the sections 50, 51 is preferably at least 25% of the highest normal force sections and more preferably at least 50% of the highest normal force. In the present example, differences between the speeds of the conveyor belts 3, 5 of the downstream station 101 and the conveyor belts 3, 5 of the upstream station are accommodated by slip between the postal item and the conveyor belts 3, 5 of the upstream station while the postal item is simultaneously engaged by the two stations 100, 101, since the applied normal forces are higher in the downstream station 101 than in the upstream station 100.

Figure 2:
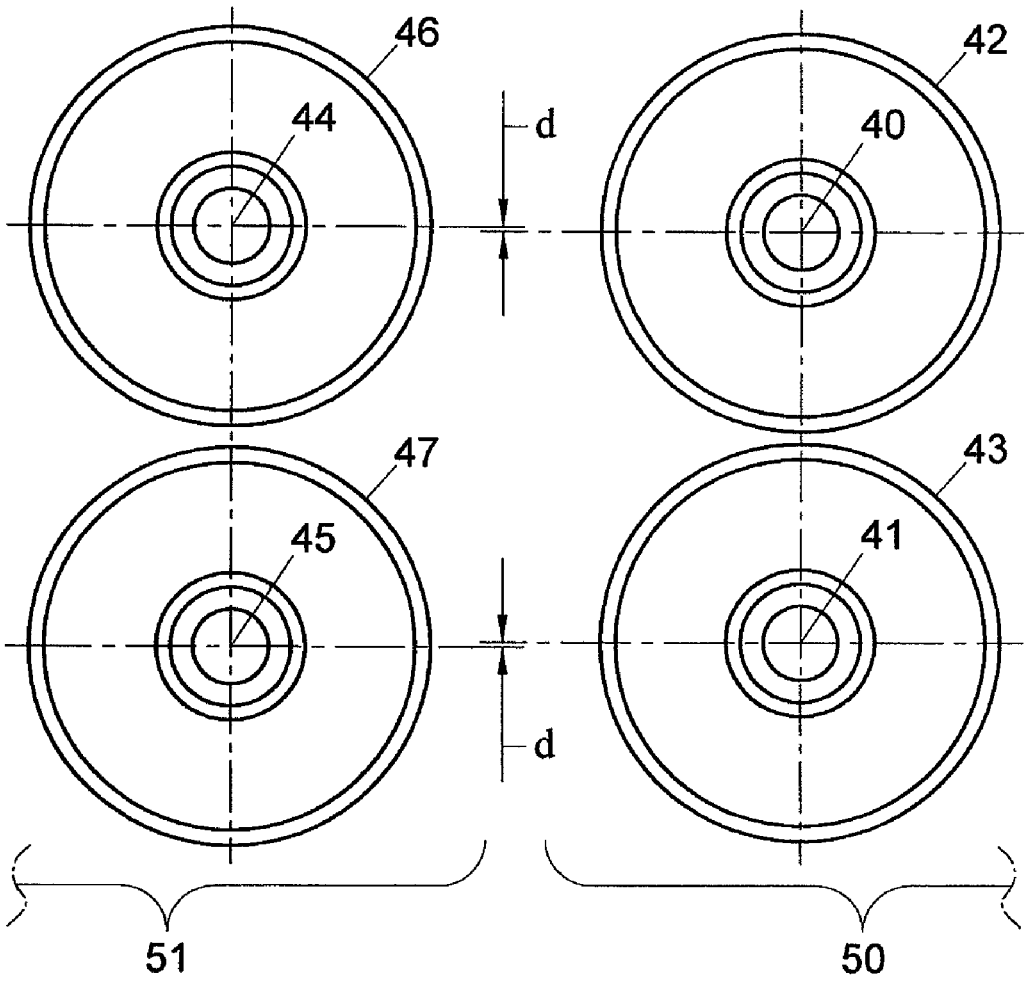
FIG. 2 is an enlarged side view of rollers shown in a portion II of FIG. 1.

As is best seen in FIG. 2, the differences between the normal forces applied in the upstream and downstream sections 50, 51 of the transport track 1 within each of the first and second stations 100, 101 are achieved in a simple manner by providing that the mutual distances between the axes of rotation 40, 41 of pairs of rollers 42, 43 diametrically opposite of each other in the upstream sections 50 is larger than the mutual distances between the axes of rotation 44, 45 of pairs of rollers 46, 47 diametrically opposite of each other in the downstream sections 51. This allows to achieve the differences between the applied normal forces while using identical rollers of the same width, diameter and material hardness in both the upstream and downstream sections 50, 51 of the transport track 1 in each of the stations 100, 101. The difference 2*d between these mutual distances may for instance be 0.2 to 0.4 mm for 35 mm rollers, but depends on the stiffness of the rollers. In FIG. 1, not all the rollers 42, 43, 46, 47 are designated by reference numerals.

The difference between the friction exertable onto a postal item by the circulatable surfaces of an upstream station and the traction simultaneously exertable on that postal item by the circulatable surfaces of the neighboring downstream station, as the postal item is passed from the upstream station to the downstream station may be further increased, by providing that the circulatable surfaces in at least a downstream section of the transport track of the upstream station have a friction coefficient relative to paper different from the friction coefficient relative to paper of the circulatable surfaces in at least an upstream section of the transport track of the second station.

Another manner of increasing the difference between the friction exertable onto a postal item by the circulatable surfaces of an upstream station and the traction simultaneously exertable on that postal item by the circulatable surfaces of the neighboring downstream station, as the postal item is passed from the upstream station to the downstream station, is to provide that the circulatable surfaces in at least an upstream section of the transport track in the downstream station or the circulatable surfaces in at least a downstream section of the transport track in the upstream station are coupled to the drive via a slip coupling. Thus, the exertable traction or friction may be limited in a simple manner and without causing slip along surfaces of the postal items.

While the invention has been illustrated and described in detail in the drawings and foregoing description, such illustration and description are to be considered illustrative or exemplary and not restrictive; the invention is not limited to the disclosed embodiments.

For example, instead of or in addition to conveyor belts, other circulatable surfaces such as circumferential surfaces of rollers may be arranged on opposite sides of the transport track and thereby define at least portions of the transport track. Also, the number of successive stations through which the transport track extends may be different and the stations may be arranged for adding documents between upstream and downstream sections of the transport track within the respective stations.

Other variations to the disclosed embodiments can be understood and effected by those skilled in the art in practicing the claimed invention, from a study of the drawings, the disclosure, and the appended claims.

The invention claimed is:

1. A system for processing paper postal items, comprising a first station a second station; and a transport track extending through said stations for transporting stacks of at least two paper postal items in a transport direction through said first station and from said first station into and through said second station;

wherein each of said stations comprises:

at least one first circulatable surface on a first side of the transport track for guiding postal item material along the transport track;

at least one second circulatable surface, opposite of the at least one first circulatable surface for exerting a normal force towards said at least one first circulatable surface;

a first drive for driving at least one of the circulatable surfaces of the first station; and a second drive for driving at least one of the circulatable surfaces of the second station;

wherein the first drive is controlled for driving the at least one of the first station's circulatable surfaces at a first circumferential speed;

wherein the second drive is controlled for driving the at least one of the second station's circulatable surfaces at a second circumferential speed higher than said first circumferential speed;

wherein said circulatable surfaces in at least a downstream section of the transport track in said first station and said circulatable surfaces in at least an upstream section of the transport track in said second station are arranged such that, in operation, for each of the stacks, the highest normal force exerted on the stack by said circulatable surfaces in at least a downstream section of the transport track in said first station is substantially larger or smaller than the highest normal force exerted on the stack by said circulatable surfaces in at least an upstream section of the transport track in said second station; and wherein in at least said first and second stations, the circulatable surfaces are arranged such that, in operation, for each of the stacks, the highest normal force exerted onto an engaged by said circulatable surfaces in a downstream section of the transport track in said station is substantially larger or substantially smaller than the highest normal force exerted on said postal item by said circulatable surfaces in an upstream section of the transport track in said station.

2. A method for processing paper postal items, comprising transporting a stack of at least two stacked postal items along from a first station to a second station;

said stations each comprising:

at least one first circulatable surface on a first side of a transport track for guiding postal item material along the transport track; and at least one second circulatable surface, opposite of the at least one first circulatable surface for exerting a normal force towards said at least one first circulatable surface;

the method further comprising:

driving at least one of the circulatable surfaces of the first station at a first circumferential speed;

driving at least one of the circulatable surfaces of the second station at a second circumferential speed higher than said first circumferential speed;

wherein the highest normal force exerted on the stack by said circulatable surfaces in at least a downstream section of the transport track in said first station is substantially larger or smaller than the highest normal force exerted on the stack by said circulatable surfaces in at least an upstream section of the transport track in said second station; and wherein in at least said first and second stations, the highest normal force exerted on the stack by said circulatable surfaces in a downstream section of the transport track in said station is substantially larger or substantially smaller than the highest normal force exerted on the stack by said circulatable surfaces in an upstream section of the transport track in said station.

3. A system according to claim 1, wherein the first and second stations are interchangeable with each other.

4. A system according to claim 1, wherein said circulatable surfaces in at least a downstream section of the transport track in said first station have a friction coefficient relative to paper substantially larger or smaller than the friction coefficient relative to paper of said circulatable surfaces in at least an upstream section of the transport track in said second station.

5. A system according to claim 1, further including a postal item feeder controllable for adding a postal item to a postal item in the transport track in a position with a trailing or leading edge of the postal item in the transport track and the added postal item in mutual alignment.

6. A method according to claim 2, wherein the stack of postal items is aligned along a leading edge and wherein, while the stack of postal items is simultaneously engaged by the circulatable surfaces of the first and second stations while passing from the first station to the second station, the highest normal force exerted by the circulatable surfaces of the second station on the stack of postal items is higher than the highest normal force exerted on the same stack of postal items by the circulatable surfaces of the first station.

7. A method according to claim 2, wherein the stack of postal items is aligned along a trailing edge and wherein, while the stack of postal items is simultaneously engaged by the circulatable surfaces of the first and second stations while passing from the first station to the second station, the highest normal force exerted by the circulatable surfaces of the second station on the stack of postal items is lower than the highest normal force exerted on the same stack of postal items by the circulatable surfaces of the first station.

* * * * *